US006755731B2

(12) United States Patent
Lee

(10) Patent No.: US 6,755,731 B2
(45) Date of Patent: Jun. 29, 2004

(54) COIN ASSORTMENT BOX STRUCTURE OF COIN SORTING MACHINE

(75) Inventor: Jongsuk Lee, Kyunggi-do (KR)

(73) Assignee: Royal Sovereign, Inc., Inchon (KR)

( * ) Notice: Subject to any disclaimer, the term of this patent is extended or adjusted under 35 U.S.C. 154(b) by 134 days.

(21) Appl. No.: 10/124,071

(22) Filed: Apr. 17, 2002

(65) Prior Publication Data

US 2003/0199240 A1 Oct. 23, 2003

(51) Int. Cl.[7] ..... G07D 9/06
(52) U.S. Cl. ..... 453/59
(58) Field of Search ..... 453/59, 3, 61, 453/16, 63; 53/212

(56) References Cited

U.S. PATENT DOCUMENTS

| | | | | | |
|---|---|---|---|---|---|
| 4,407,314 | A | * | 10/1983 | Ventura | 453/59 |
| 4,694,845 | A | * | 9/1987 | Zay | 453/59 |
| 4,741,720 | A | * | 5/1988 | Vargo | 453/58 |
| 6,554,693 | B2 | * | 4/2003 | Lee | 453/14 |
| 6,638,157 | B2 | * | 10/2003 | Perkitny | 453/13 |
| 2003/0013402 | A1 | * | 1/2003 | Lim | 453/59 |

FOREIGN PATENT DOCUMENTS

| | | | | |
|---|---|---|---|---|
| GB | 2.225.890 A | * | 6/1990 | G07F/9/04 |
| JP | 3-260892 A | * | 11/1991 | G07D/9/00 |

* cited by examiner

*Primary Examiner*—Donald P. Walsh
*Assistant Examiner*—Mark J. Beauchaine
(74) *Attorney, Agent, or Firm*—Roberts Abokhair & Mardula, LLC

(57) ABSTRACT

A coin-sorting machine with a coin assortment box structure is disclosed. A plurality of coin guides are formed at front and rear of upper openings of coin receiver-accommodating containers, each having a certain length and height, for guiding the sorted coins. A stray coin-recovering drawer with an inclined structure integrally formed with it is disposed under the coin assortment box. A coin receiver-lifting device consists of a support and a plurality of pushrods. The support is mounted upon an inclined structure of the stray coin-recovering drawer. The plurality of pushrods are inserted into slits of the coin receiver-accommodating containers so as to push up the coin receivers of the coin receiver-accommodating containers. Thus the coin guides guide the sorted coins accurately into the relevant coin receivers, and the coin receivers within the coin receiver-accommodating containers are lifted by the coin receiver-lifting device so as to make it possible to take out the sorted coin packs in an easier manner.

6 Claims, 6 Drawing Sheets

COIN ASSORTMENT BOX STRUCTURE OF COIN SORTING MACHINE

FIELD OF THE INVENTION

The present invention relates to a coin assortment box structure of a coin sorting machine, in which a plurality of coin guides are formed at front and rear of upper openings of coin receiver-accommodating containers, each having a certain length and height, for guiding sorted coins; a support for supporting a plurality of pushrods is mounted upon an inclined structure of a stray coin-recovering drawer; and the plurality of pushrods are inserted into slits of the coin receiver-accommodating containers so as to push up coin receivers of the coin receiver-accommodating containers, the support and the pushrods constituting a receiver-lifting device, whereby the coin guides guide the sorted coins accurately into the relevant coin receivers, and the coin receivers accommodated within the coin receiver-accommodating containers are lifted by the coin receiver-lifting device so as to make it possible to recover the sorted coins.

BACKGROUND OF THE INVENTION

Generally, a coin sorting machine includes: a coin-sorting device for sorting the coins in accordance with their sizes; a coin assortment box installed under the coin-sorting device, and having a plurality of coin receiver-accommodating containers of different diameters; and a stray coin-recovering drawer installed in the lower portion of the coin assortment box, and having an inclined structure at its end.

The coin receiver-accommodating containers are detachably installed in the coin assortment box, and the coin receivers are accommodated in the coin receiver-accommodating containers, so that they can receive the sorted coins from the coin-sorting device.

Further, the inclined structure of the stray coin-recovering drawer supports the coin receiver-accommodating containers of the coin assortment box, as well as supporting the coin receivers of the containers. Thus the coin receiver-accommodating containers of the coin assortment box and the coin receivers of the containers ascend or descend in accordance with the opening or closing of the stray coin-recovering drawer.

In this conventional coin-sorting machine, however, the coins that have been sorted by the coin-sorting device are not guided, and consequently, the sorted coins are liable not to be dropped into the relevant receivers, but liable to go astray. Thus errors are apt to occur in this conventional coin-sorting machine.

Further, if the coins are to be collected from the coin assortment box, then the first the stray coin-recovering drawer has to be open, and the coin receiver-accommodating containers of the coin assortment box and the coin receivers of the coin receiver-accommodating containers have to be raised simultaneously. Further, the coin receiver-accommodating containers have to be withdrawn by hand from the coin assortment box.

Further, the coin receivers have to be withdrawn from the coin receiver-accommodating containers by hand. Thus the manual procedure consists of a plurality of steps, and therefore, the coin sorting work is troublesome, as well as consuming too much time.

Further, when the coin receiver-accommodating containers and the coin receivers are raised simultaneously, vibrations occur, with the result that the coins are liable to be projected away to the outside.

SUMMARY OF THE INVENTION

The present invention is intended to overcome the above-described disadvantages of the conventional technique.

Therefore, it is an object of the present invention to provide a coin assortment box structure of a coin sorting machine, in which the coins are not lost during the sorting, and the coin sorting task is rendered easier.

In achieving the above object, the coin assortment box structure of a coin sorting machine according to the present invention includes: a plurality of coin guides formed at front and rear of upper openings of coin receiver-accommodating containers, each having a certain length and height, for guiding the sorted coins; and a coin receiver-lifting device consisting of: a support mounted upon an inclined structure of a stray coin-recovering drawer; a plurality of pushrods inserted into slits of the coin receiver-accommodating containers so as to push up the coin receivers of the coin receiver-accommodating containers, whereby the coin guides guide the sorted coins accurately into the relevant coin receivers, and the coin receivers within the coin receiver-accommodating containers are lifted by the coin receiver-lifting device so as to make it possible to sort the coins accurately.

BRIEF DESCRIPTION OF THE DRAWINGS

The above object and other advantages of the present invention will become more apparent by describing in detail the preferred embodiment of the present invention with reference to the attached drawings in which.

DESCRIPTION OF THE PREFERRED EMBODIMENTS

Figure 1:
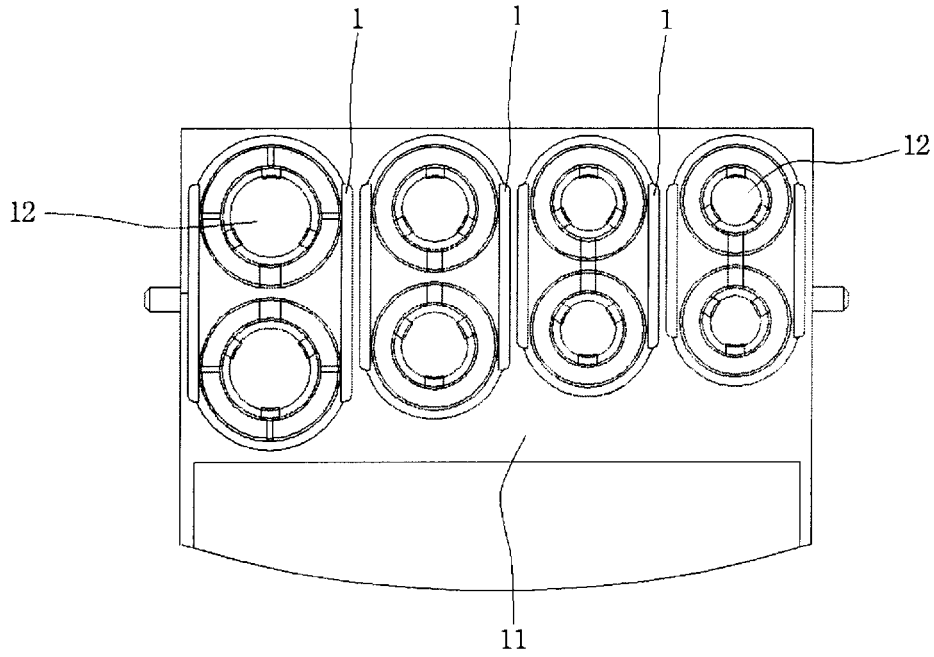
FIG. 1 is a plan view of the coin assortment box according to the present invention.
Figure 2:
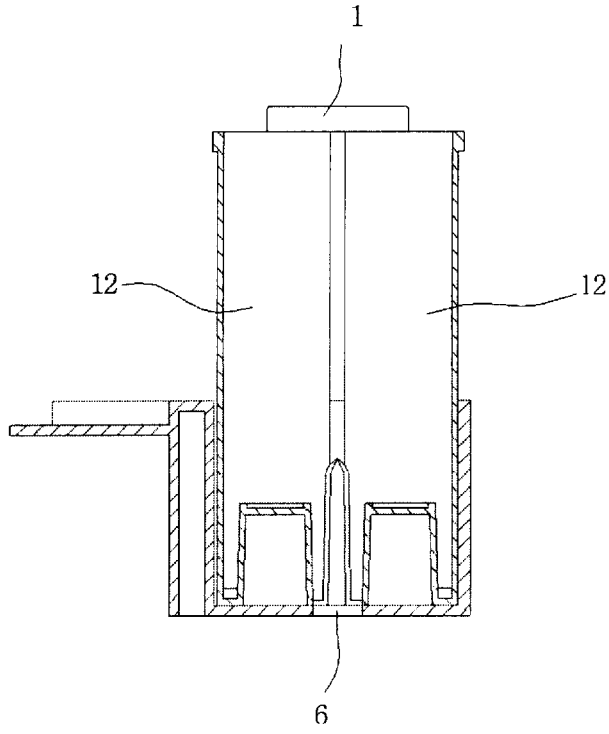
FIG. 2 is a side view of the coin assortment box according to the present invention.
Figure 3A:
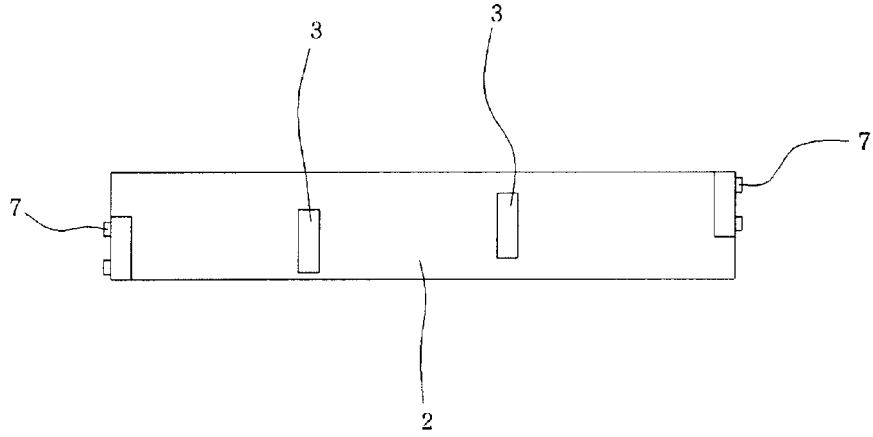
FIG. 3*a* is a plan view of the coin receiver-lifting device according to the present invention.
Figure 3B:
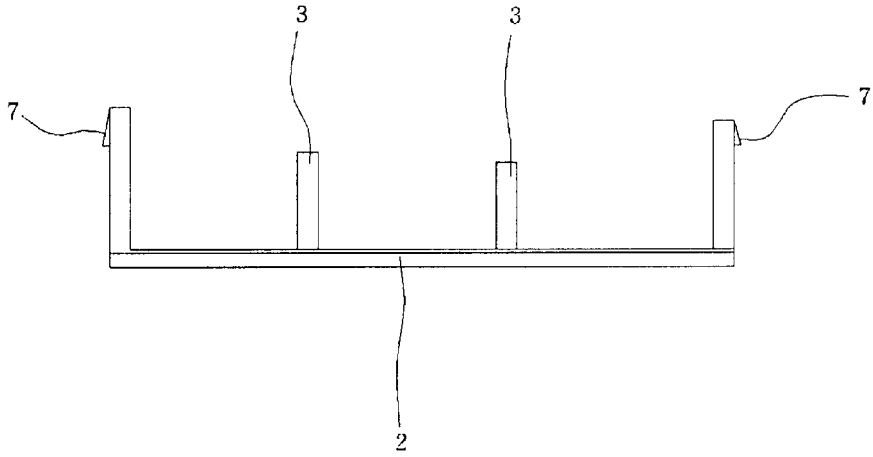
FIG. 3*b* is a frontal view of the coin receiver-lifting device according to the present invention.
Figure 4A:
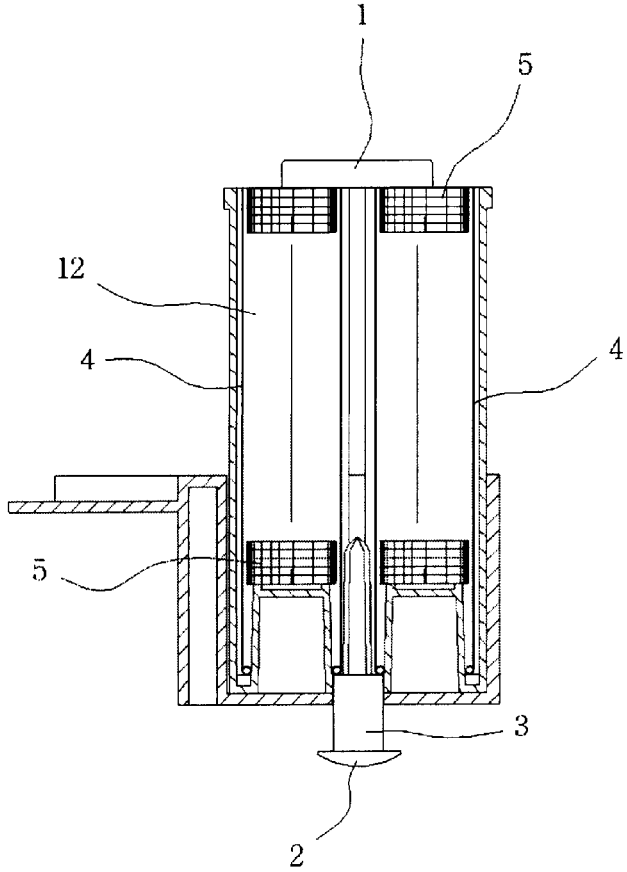
FIG. 4*a* is a side view of the coin receiver-lifting device according to the present invention, with the device being lowered.
Figure 4B:
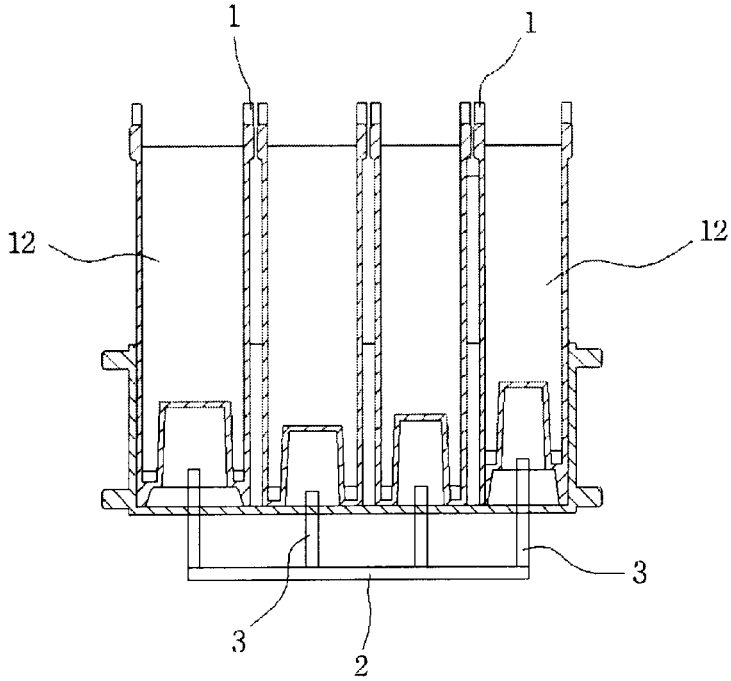
FIG. 4*b* is a frontal view of the coin receiver-lifting device according to the present invention, with the device being lowered.
Figure 5A:
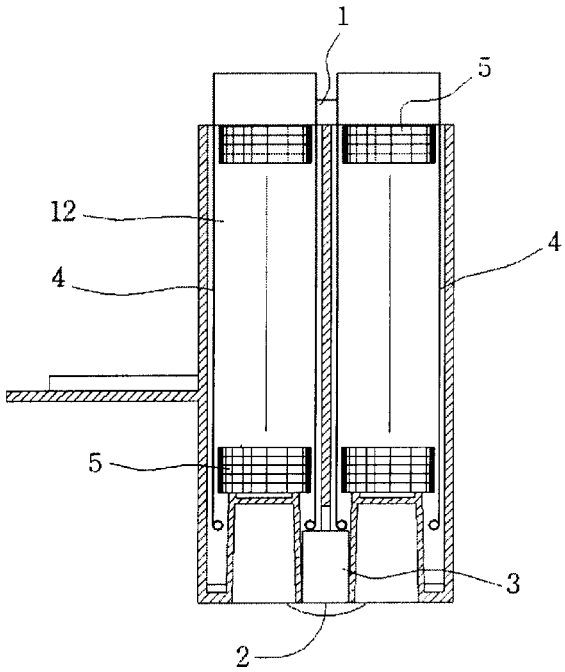
FIG. 5*a* is a side view of the coin receiver-lifting device according to the present invention, with the device being raised.
Figure 5B:
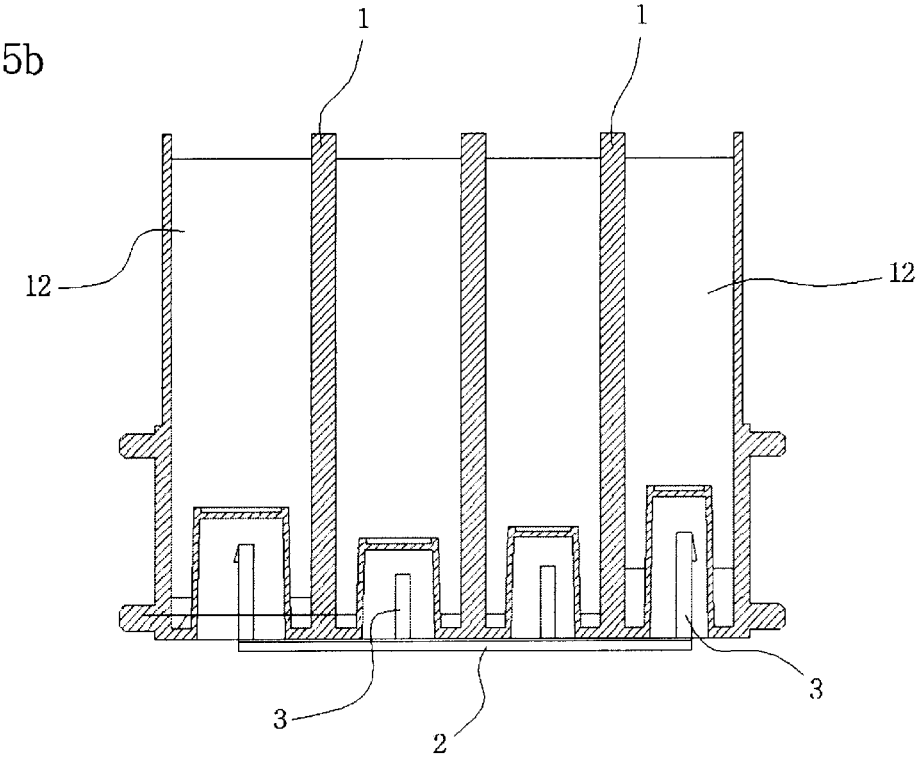
FIG. 5*b* is a frontal view of the coin receiver-lifting device according to the present invention, with the device being raised.
Figure 6:
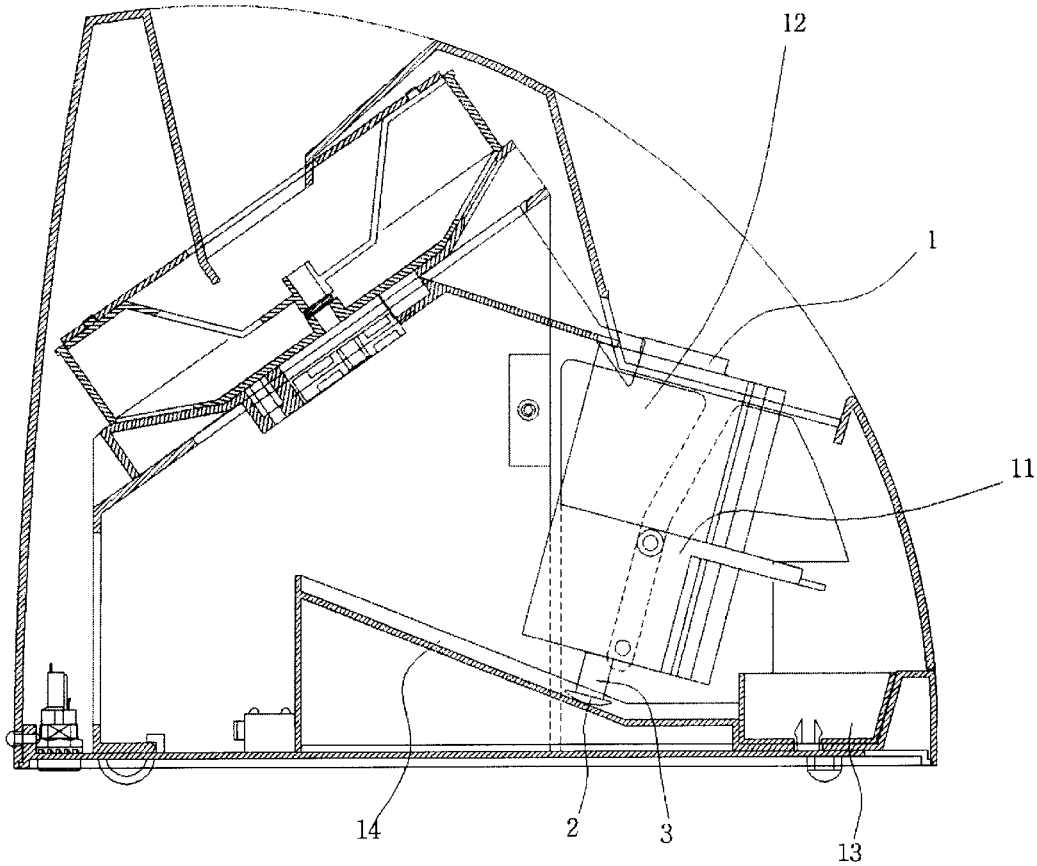
FIG. 6 illustrates the stray coin-recovering drawer according to the present invention, with the drawer being closed.
Figure 7:
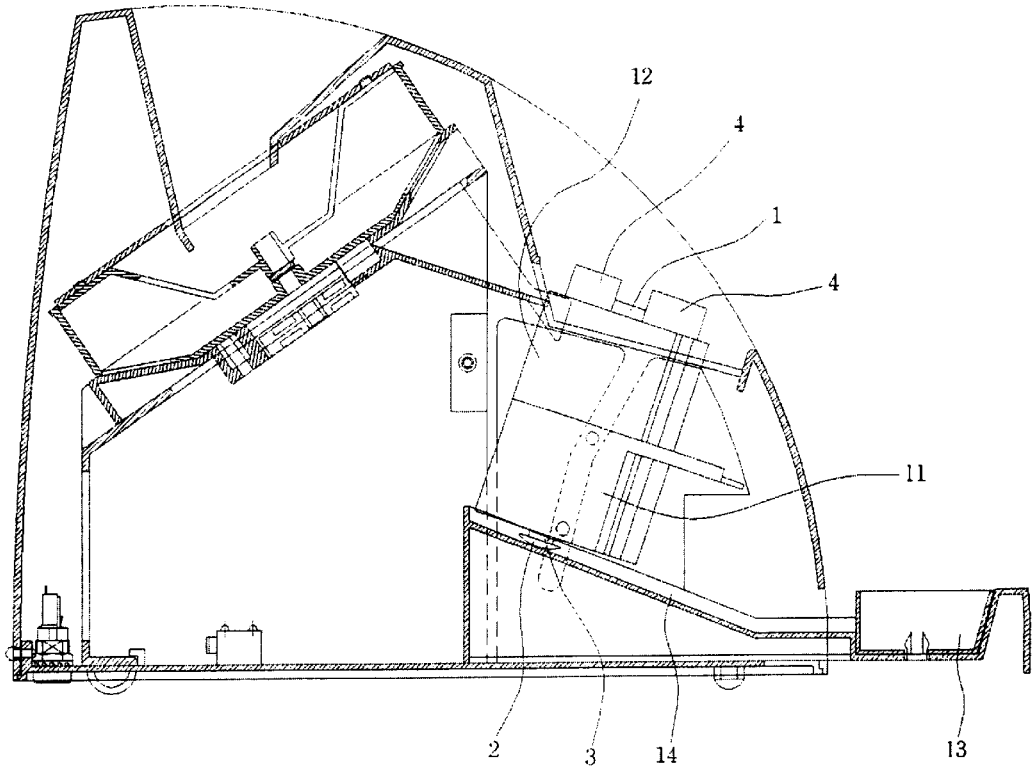
FIG. 7 illustrates the stray coin-recovering drawer according to the present invention, with the drawer being open.

Now the present invention will be described in detail referring to the attached drawings.

The coin assortment box structure of a coin sorting machine according to the present invention includes: a plurality of coin guides 1 formed at front and rear of upper openings of coin receiver-accommodating containers 12, each having a certain length and height, for guiding the sorted coins 5; and a coin receiver-lifting device consisting of: a support 2 mounted upon an inclined structure 14 of a stray coin-recovering drawer 13; a plurality of pushrods 3 inserted into slits 6 of the coin receiver-accommodating containers 12 so as to push up coin receivers 4 of the coin receiver-accommodating containers 12.

A coin assortment box in which the coin receiver-accommodating containers 12 are integrally formed is installed beneath a sorting device.

The inside diameter of each of the coin receiver-accommodating containers 12 is same as the outside diameter of each of the coin receivers 4, and the coin receiver 4 is inserted into the coin receiver-accommodating container 12 through the upper opening of the latter so as to be accommodated therein.

The coin receiver-accommodating containers 12 are formed integrally with the coin assortment box 11, and therefore, when the stray coin-recovering drawer 13 is opened or closed, there are generated no vibrations on the coin receiver-accommodating containers 12.

A plurality of the coin receiver-accommodating containers 12 are arranged in straight lines within the coin assortment box, and a plurality of coin guides 1 are formed between the coin receiver-accommodating containers 12.

The coin guides 1 respectively have sufficient lengths and heights, so that the sorted coins 5 would not flow in wrong directions. That is, the coin guides guide the sorted coins in the correct direction, so that the sorted coins 5 would be led to the exactly correct coin receivers 4.

The coin receiver 4 which is sleeve-shaped and is accommodated in each of the coin receiver-accommodating containers is inwardly coiled at one end of it so as to form a coin supporting part, while the other end of it is completely open so as to received the sorted coins 5. Thus the coin receiver 4 may be a packing paper.

In an alternative embodiment, the coin receiver 4 is inwardly bent at one end of it so as to form a coin supporting part, while the other end is completely open so as to receive the sorted coins 5. In this case, the coin receiver 4 may be a hard coin-receiving tube.

The coin-receiving tube may receive a both-end-open coin-packing paper, and in this case, the coin packing paper can be drastically cheaper.

A coin receiver-lifting device consists of a support 2 and a plurality of pushrods 3, and this lifting device is formed in the lower portion of the coin assortment box 11.

The support 2 is mounted upon the inclined structure 14 of the stray coin-recovering drawer 13.

If the stray coin-recovering drawer 13 is pulled out, and thus if the inclined structure 14 is pulled forward, then the support 2 and the pushrods 3 are lifted up. On the other hand, if the stray coin-recovering drawer 13 is pushed back, and thus if the inclined structure 14 is also pushed back, then the support 2 and the pushrods 3 are lowered down.

The bottom of the support 2 should be preferably round, so that the frictions between the support 2 and the inclined structure can be diminished.

Hooks 7 are formed on the two outermost pushrods 3, so that the coin receiver-lifting device can be prevented from departing from the coin receiver-accommodating containers 12.

Correspondingly with the positions and shapes of the pushrods 3, there are formed slits 6 in the lower portions of the coin receiver-accommodating containers 12.

If the stray coin-recovering drawer 13 is closed, the pushrods 3 are only partly inserted into the slits 6. On the other hand, if the drawer 13 is withdrawn (opened), the pushrods 3 rise up into the slits 6 of the coin receiver-accommodating containers 12 to push up the coin receivers 4 and the sorted coins to above the coin receiver-accommodating containers 12, thereby making it possible to take out the packed coin block.

That is, if the stray coin-recovering drawer 13 is open, the coin receiver-lifting device (consisting of the support 2 and the pushrods 3) which is mounted on the inclined structure 14 rises. Thus in this case, the pushrods 3 push up the coin receivers 4 of the coin receiver-accommodating containers 12 above them.

On the other hand, if the stray coin-recovering drawer 13 is closed, the coin receiver-lifting device which is mounted on the inclined structure 14 descends. Thus the status becomes such that the coin receivers 4 can be accommodated within the coin receiver-accommodating containers 12.

Now the first embodiment of the present invention will be described as to its action and effects.

The stray coin-recovering drawer 13 is opened, and then, one-end-open coin-packing papers are inserted into the respective coin receiver-accommodating containers 12 of the coin assortment box 11.

Then if the stray coin-recovering drawer 13 is pushed back (closed), the inclined structure 14 is also pushed back, with the result that the one-end-open coin-packing papers come down to be settled within the coin receiver-accommodating containers 12.

Then the coins 5 are sorted by means of the coin-sorting device, and the sorted coins 5 move through the respective channels to be guided by the coin guides 1 into the respective one-end-open coin-packing papers in accordance with the sizes of the coins 5.

When the coin sorting is completed or when the coins are completely filled into the coin-packing papers, the stray coin-recovering drawer 13 is pulled out (opened). Thus the inclined structure 14 is pulled forward together, and therefore, the coin receiver-lifting device pushes up the coin-packing papers within the coin receiver-accommodating containers 12 to push out the coin-packed papers.

Then the coin-packed paper blocks are taken out, and then the open end of the paper block is folded to a final form, thereby finishing the coin sorting. Then other one-end-open coin-packing papers are put into the coin receiver-accommodating containers 12.

Then if the stray coin-recovering drawer 13 is pushed back (closed), the inclined structure 14 is also pushed back, with the result that the newly inserted coin-packing papers are made to come down so as to be settled within the coin receiver-accommodating containers 12. This procedure can be repeated continuously to sort the coins 5.

Since the coin receiver-accommodating containers 12 are formed integrally with the coin assortment box 11, vibrations are not generated during the opening and closing of the stray coin-recovering drawer 13. Consequently, vibrations are not generated also in the coin receiver-accommodating containers, and accordingly, coins are not projected astray to the outside.

Now another embodiment of the present invention will be described as to its action.

First, the stray coin-recovering drawer 13 is opened, and then, the coin-receiving tubes are accommodated into the respective coin receiver-accommodating containers 12. Then if the stray coin-recovering drawer 13 is pushed back (closed), then the inclined structure 14 is pushed back at the same time, and the coin-receiving tubes come down to be settled in the coin receiver-accommodating containers 12.

Then the coins 5 are sorted by the coin-sorting device, and the sorted coins 5 pass through respective passages to be received into the respective coin-receiving tubes by being guided by the coin guides 1 in accordance with the sizes of the coins 5.

When the coins 5 are completely sorted, or when the coins 5 are completely filled in the respective coin-receiving tubes, if the stray coin-recovering drawer 13 is pulled out, then the inclined structure 14 is pulled forward at the same time. Then at the same time, the coin receiver-lifting device which is mounted upon the inclined structure 14 pushes up the coin-receiving tubes which are accommodated within the respective coin receiver-accommodating containers 12, so as to make the coin-receiving tubes protrude above the coin receiver-accommodating containers 12.

Then the coin-receiving tubes are taken out of the coin receiver-accommodating containers 12. After taking out the coin-receiving tube, a both-end-open coin-packing paper is inserted into the coin-receiving tube from above, thereby accommodating the stacked coins 5. Then the upper opening of the both-end-open coin-packing paper is folded, and it is set upside-down. Then the both-end-open coin-packing paper is detached, and then, the other end of the both-end-open coin-packing paper is folded, thereby recovering the sorted coins 5.

Then new coin-receiving tubes are accommodated into the respective coin receiver-accommodating containers 12. Then if the stray coin-recovering drawer 13 is pushed back (closed), then the inclined structure 14 is also pushed back, with the result that the coin-receiving tubes come down at the same time to be settled within the respective coin receiver-accommodating containers 12. Thus the coin sorting can be repeatedly carried out.

According to the present invention as described above, the sorted coins are guided by the coin guides, so that the sorted coins can be accurately put in the relevant coin receivers respectively, thereby preventing any sorting errors. Further, the coin receiver-lifting device pushes up the coin receivers within the coin receiver-accommodating containers so as for the coin receivers to protrude above the coin receiver-accommodating containers, thereby making it easier to take out the sorted coin packs.

Although the preferred embodiments of the present invention have been disclosed for illustrative purposes, those skilled in the art will appreciate that various modifications, additions and substitutions are possible, without departing from the scope of the invention as disclosed in the accompanying claims.

What is claimed is:

1. A coin-sorting machine with a coin assortment box structure, comprising:

a coin-sorting device for sorting coins in accordance with their sizes;

a coin assortment box installed beneath the coin-sorting device, and with a plurality of coin receiver-accommodating containers of different sizes integrally formed therein;

a stray coin-recovering drawer with an integrally-formed inclined structure disposed under the coin assortment box;

a plurality of coin receivers accommodated into the coin receiver-accommodating containers of the coin assortment box, respectively; and a bottom of the coin assortment box being mounted upon the inclined structure of the stray coin-recovering drawer, wherein the coin assortment box further comprises:

a plurality of coin guides formed at front and rear of upper openings of coin receiver-accommodating containers, each having a certain length and height, for guiding sorted coins; and a receiver-lifting device consisting of: a support mounted upon the inclined structure of the stray coin-recovering drawer; and a plurality of pushrods inserted into slits of the coin receiver-accommodating containers so as to push up the coin receivers within the coin receiver-accommodating containers.

2. The coin-sorting machine as claimed in claim 1, wherein the coin receiver has a shape of a sleeve, and consists of a coin-packing paper with one end inwardly coiled to form a coin-supporting part.

3. The coin-sorting machine as claimed in claim 1, wherein the coin receiver has a shape of a sleeve, and consists of a coin-receiving tube with its one end bent inward to form a coin-supporting part.

4. The coin-sorting machine as claimed in claim 1, wherein a slit is formed on a lower portion of each of the coin receiver-accommodating containers of the coin assortment box correspondingly to position and shape of each of the pushrods of the coin receiver-lifting device.

5. The coin-sorting machine as claimed in claim 1, wherein the support has a round bottom so as to decrease frictions between the support and the inclined structure of the stray coin-recovering drawer.

6. The coin-sorting machine as claimed in claim 1, wherein engaging parts are formed on outermost pushrods of the coin receiver-lifting device so as to prevent any departure of the coin receiver-lifting device from the coin receiver-accommodating containers.

* * * * *